United States Patent [19]

Bullock, III

[11] Patent Number: 4,739,891

[45] Date of Patent: Apr. 26, 1988

[54] PLASTIC BOTTLE CAP HAVING FOIL NECK SEAL

[75] Inventor: Joseph J. Bullock, III, Atherton, Calif.

[73] Assignee: Velo Bind, Inc., Sunnyvale, Calif.

[21] Appl. No.: 70,616

[22] Filed: Jul. 10, 1987

Related U.S. Application Data

[63] Continuation of Ser. No. 855,723, Apr. 25, 1987, abandoned.

[51] Int. Cl.[4] ..... B65D 41/48

[52] U.S. Cl. ..... 215/232; 215/350

[58] Field of Search ..... 215/232, 350, 256; 220/359

[56] References Cited

U.S. PATENT DOCUMENTS

| | | | |
|---|---|---|---|
| 3,352,268 | 11/1967 | Koll . | |
| 3,734,044 | 5/1973 | Asmus . | |
| 3,917,100 | 11/1975 | Dukess | 215/350 X |
| 3,961,566 | 6/1976 | Westphal et al. | 220/359 X |
| 3,974,932 | 8/1976 | Faulstich | 215/256 |
| 4,047,473 | 9/1977 | Fletcher . | |
| 4,109,815 | 8/1978 | Collins | 215/350 X |
| 4,155,439 | 5/1979 | Fletcher et al. . | |
| 4,166,552 | 9/1979 | Faulstich | 215/256 |
| 4,438,857 | 3/1984 | Bullock | 215/256 |
| 4,484,687 | 11/1984 | Bullock | 215/256 |

*Primary Examiner*—Donald F. Norton

*Attorney, Agent, or Firm*—Julian Caplan

[57] ABSTRACT

To resist tampering with the contents of containers, a plastic cap is provided with a foil liner. When the cap is seated on the container neck, the foil is caused to be sealed across the neck. To inhibit the foil from coming loose from the cap before closure a circumferential groove is formed in the inside of the skirt wall immediately below the cap top disc. The outer edge of the foil snaps into the groove but does not remain in the groove when the cap is removed for dispensing contents. A tab is formed extending out from the edge of the foil to be gripped by the consumer to remove the foil. This tab is folded over when the tab and cap are intact.

2 Claims, 1 Drawing Sheet

PLASTIC BOTTLE CAP HAVING FOIL NECK SEAL

This is a continuation, of application Ser. No. 06/855,723 filed Apr. 25, 1987, now abandoned.

CROSS REFERENCE TO RELATED PATENT

This application is for an improvement on U.S. Pat. No. 4,484,687, issued Nov. 27, 1984.

BACKGROUND OF THE INVENTION

1. Field of the Invention

This invention relates to a tamper-resistant closure for use with container necks characterized in that the neck is sealed with a foil disc.

2. Description of Related Art

Reference is made to U.S. Pat. No. 4,484,687 and the references cited therein.

Foil liner seals have been used to close the necks of containers as a means to assist in detecting tampering with the contents of the container. Such commercially available seals are applied to the container neck and are caused to adhere thereto by induction heating or other means. In a preferred embodiment of this invention, such commercially available foil liner seals are used. To facilitate installation on the container neck, the seal is initially inserted into the cap and remains therein until the container is opened by the consumer. The underside of the foil seal preferrably has an adhesive so that, after the cap has been applied to the neck, the adhesive comes into intimate contact with the neck. Induction heating, or other means, then causes the foil seal and adhesive to adhere to the neck finish.

One feature of the present invention is the formation of a groove on the interior of the cap skirt into which the margin of the foil seal snaps and remains until the cap is removed from the container neck. The groove holds the foil liner seal in place prior to the cap being applied to the container.

Another feature of the invention is the provision of a foil tab integral with the foil seal which may be gripped by the consumer to assist in pulling the foil off the container neck finish. Preferably, this tab is folded over the seal disc and nests between the foil and the underside of the top disc of the cap. To use the tab after the cap has been removed, the consumer may insert a fingernail or other instrument under the folded over tab and pull it to upright or upward extending position.

Another feature of the present invention is the fact that the cap and container neck have cooperating locking means to hold the cap securely in place until the lower portion thereof may be torn off. Tearing the skirt gives visual evidence of tampering. The interlocking means are preferably beads and the beads may be either continuous, as illustrated in FIG. 1 of the drawings, or may be interrupted as is shown in FIG. 6 or interrupted in other patterns.

Another anti-tamper-resistant feature of the present invention is the provision of a flange on the top of the cap which may be gripped by the consumer to remove the cap after the lower part of the skirt has been torn away. However, until the lower portion of the skirt has been torn off and a portion of the locking means thereby removed, the flange cannot be used by a dishonest consumer to remove the cap. Various shapes of flanges may be used, as hereinafter described.

Still another tamper-resistant feature is the use of a container neck provided with an outwardly extending shoulder against which the lower edge of the cap skirt tightly abuts to make it difficult, if not impossible, to dig one's fingernails under the skirt to pry up the cap off of the neck. The shoulder may be formed with protrusions to frustrate insertion of an implement under the skirt edge.

Other objects of the present invention will become apparent upon reading the following specification and referring to the accompanying drawing in which similar characters of reference represent corresponding parts in each of the several views.

DESCRIPTION OF PREFERRED EMBODIMENTS

Figure 5:
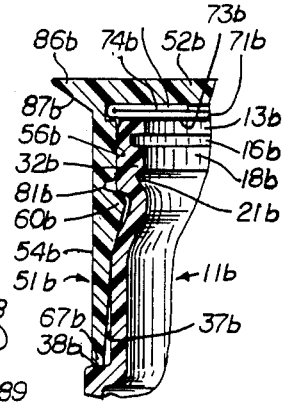
FIG. 5 is a view similar to FIG. 2 showing a further modified cap and neck.

The container neck 11 shown in the accompanying drawings is subject to some variation. In the particular form shown there is a top flange 12 which may be horizontal or upwardly-inwardly slanted having an inner edge 13. Below edge 13 is a substantially horizontally outwardly extending surface 14, which terminates in a top internal groove 16. Below groove 16, there is a vertical wall 18. Below wall 18 is a second internal groove 21 and below groove 21 is a vertical wall 23 which terminates in an outwardly-downwardly slanted wall 24 which, in turn, terminates in an internal vertical wall 25. The internal structure of the neck 11 is subject to considerable variation.

Directing attention next to the exterior of neck 11, top corner 26 where flange 12 originates is slightly rounded and merges into a top external vertical wall 27. Below wall 27 is groove 29 the base of which is a second vertical wall forming shoulder 28. First external locking bead 22 is generally the portion of the exterior of the neck 11 between the rounded corner 26 and the groove 29. Below groove 29 is a downwardly-outwardly slanted wall 31 which comprises the top surface of second external locking bead 32. The lower edge of bead 32 comprises a substantially horizontal shoulder 33. Below shoulder 33 is a third external vertical wall 34 which is of lesser diameter than groove 29. Below wall 24 is an outwardly slanted wall 36 which terminates in a fourth external vertical wall 37 which has a diameter greater than wall 27.

Figure 2:
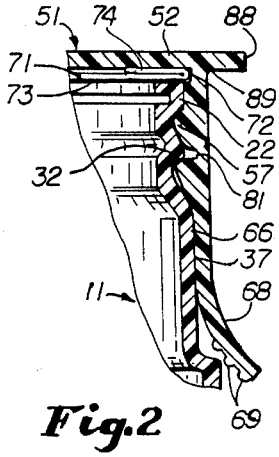
FIG. 2 is view similar to FIG. 1 and showing the cap and neck assembled, but also showing a modified cap removal flange.
Figure 1:
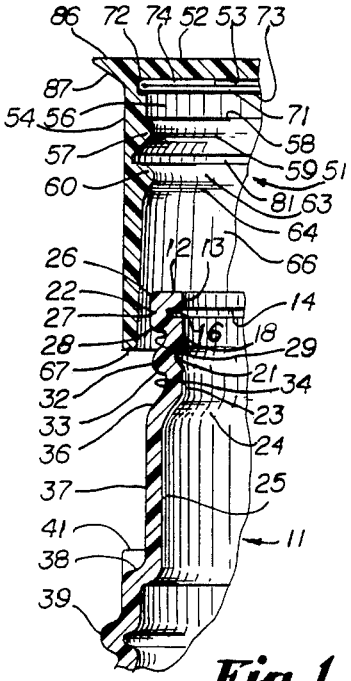
FIG. 1 is an exploded sectional view of a cap and a portion of a container neck prior to assembly thereof.

As shown in FIGS. 1 and 2, the wall 37 is of extended height to afford a broad surface against which the skirt of the cap may fit, thereby frictionally restraining unauthorized removal of the cap 51. There may be a horizontal upwardly extending shoulder 38 at the lower edge of the surface 37. Preferably, the shoulder 38 is formed with spaced projections 41, the spacing between the projections being small enough so that a fingernail or other readily accessable prying instrument cannot be inserted therebetween. Below the shoulder 38 is a bumper ring 39 here shown to be interrupted. Ring 39 is used with certain types of automatic filling and capping machinery and serves as a means whereby grippers on the machinery lift or hold the container and deposit it in the box, on a pallet, etc. The ring 39 prevents the gripper rings from contacting the cap 51 on the neck 11 and thus reduces the chance of the cap being pulled off the neck during loading.

The shape of the exterior of neck 11 is likewise subject to considerable variation.

Directing attention now to cap 51, again the structure of the cap is subject to variation and its general principles resembles the commercially highly successful cap shown in U.S. Pat. No. 4,166,552. Cap 51 has a preferably flat top disc 52 to the top of which a label or printed matter may be applied. The bottom 53 of disc 52 is also preferably flat, at least throughout a major portion of its area. Depending from disc 52 is a circular cap skirt 49, having a substantially straight vertical smooth external wall 54.

Figure 6:
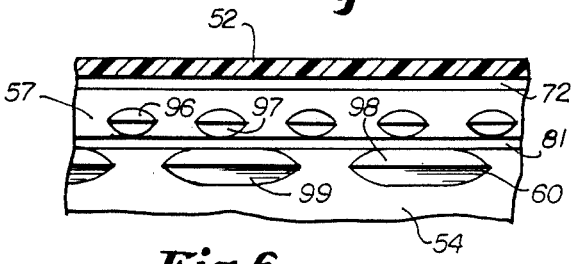
FIG. 6 is an enlarged sectional view developed in a plane showing a modified bead structure.

The inside surface of cap skirt 49 has a top internal vertical wall 56. Top locking bead means 57 on the interior of skirt 49 is positioned to lock under the bead 22 in the assembled condition of the cap and neck (See FIG. 2). As illustrated herein, the bead 57 is continuous. However, as is explained in U.S. Pat. No. 4,166,552, and as shown in FIG. 6 the top bead 57 may be interrupted. The interrupted bead means 57 has a substantially horizontal top surface 96 and downwardly slanted surface 97.

Below the beads 57 is second or lower bead means 60 located to lock under bead 32 of neck 11. The bead means 60 may be continuous or, as shown in FIG. 6, may be interrupted. Interrupted bead means 60 has a top shoulder 98 and slanted surface 99 therebelow.

Below bead means 60 is an elongated vertical wall 66 which tightly engages the wall 37 in the assembled position of the cap and neck. The wall 66 extends down to the bottom edge 67 of the skirt. Bottom edge 67 fits tightly against the top of the projections 41 of the neck 11 in the assembled condition of the cap and neck.

In one location along bottom edge 67 there is a depending tear tab 68 which may have gripper ridges 69 on one surface, preferably the interior surface. Spaced between bead means 57 and 60 is an internal horizontal scoreline 81. Although not shown in the accompanying drawings, but well understood in this art and particularly as shown in U.S. Pat. No. 4,166,552, extending upward from the bottom edge 67 of the cap 51 in immediate proximity to the tear tab 68 is a curved or slanted scoreline which merges with the scoreline 81.

A particular feature of the present invention is that prior to the cap 51 being applied to the neck 11 a foil sealing disc 71 of commercially available type is inserted in the cap, fitting against the bottom 53 of the disc. The diameter of disc 71 is slightly greater than that of wall 56 and there is a groove 72 formed in the inner wall of the skirt 49 into which the margin of the disc 71 snaps. The marginal edge of disc 71 is held in the groove 72 from the time of application until the cap has been removed from the neck by the consumer. The underside of the disc 71 is provided with an adhesive which, in the assembled condition of the head and neck shown in FIG. 2 contacts the flange 12 of neck 11. Induction heating means, or other commercially available means, causes the adhesive 73 to adhere to the flange 12. If an attempt is made to tamper with the contents of the container, such tampering can usually be detected by examination of the condition of the disc. 71.

Figure 3:
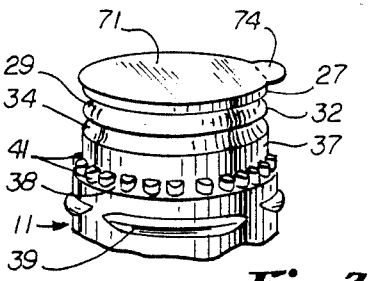
FIG. 3 is a fragmentary perspective view showing the foil disc in place on the container neck and the cap removed from the neck.

To assist in removing the disc 71, as shown in FIG. 3, there may be a foil tab 74 extending from the perimeter of disc 71 which may be gripped by the consumer to assist in pulling the disc 71 away from the neck 11. At the time of insertion of the disc 71 into the cap 51, the tab 74 may be folded over so that it is tucked over the disc 71 and under the disc 52 of the cap 51.

Various foil discs and adhesives may be used. One preferred disc is manufactured by Selig Sealing Products, Inc., of Oakbrook Terrace, Illinois, under the product name "Foil Seal 75-2-X". This disc is formed of aluminum foil of the thickness of approximately 0.0015 inches. On the underside thereof is a coating of 0.002 inch hot melt adhesive, the composition of which is proprietary. It will be understood that many different types of adhesives may be used.

A horizontal peripheral flange 86 projects out from the disc 52 at the upper end of wall 54. In the form of flange 86 shown in FIG. 1, the underside 87 slants upwardly-outwardly at an angle of about 45°. Thus, it is difficult for one to pry the cap 51 off the neck 11 while the skirt is intact. On the other hand, after the lower end of the skirt has been torn off by the consumer, the flange 86 assists the consumer in removing the top of the cap to dispense contents. An alternate structure is shown in FIG. 2 where the flange 88 is rectangular in cross-section and there is a sharp corner 89 where the flange 88 intersects the wall 54. The flange 88 may be flexible so that, if one attempts to use the flange to pry the cap off the neck before the lower portion of the cap has been torn away, the flange 88 will flex. Further, because of the sharp corner 89, the flange may tear if an attempt is made to use the flange to pry off the cap, thereby again indicating an attempt to tamper with the contents of the container has been made.

Figure 4:
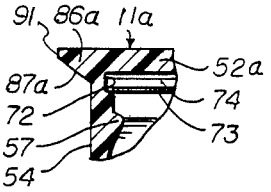
FIG. 4 is a fragmentary sectional view of a portion of a cap showing a modified flange.

FIG. 4 shows a flange **86*a* generally similar to the flange of FIG. 1, except that the outer edge 91** is truncated. Other flange shapes are contemplated.

In use of any of the forms of invention shown in FIGS. 1 through 4, after the cap 51 has been molded by injection molding of any suitable plastic, the foil 71 with the tab 74 folded back is inserted in the interior of the cap until the marginal edges of the cap 71 snap into the groove 72 on the interior of the skirt 54. Thus, the foil disc 71 is difficult to dislodge during transportation and particularly during feeding the cap through a conventional capping machine. In the capping machine, the cap 51 is pushed downwardly onto the filled container 11 so that the skirt 54 fits over the neck 11. The cap 51 is pushed downward until the beads 60 and 57 snap over the beads 32 and 22, as is well understood in the bottle cap art. The condition shown in FIG. 2 is thus achieved.

In this phase of the invention, the foil disc 71 remains in place, but the adhesive 73 on the underside of the foil contacts the top flange 12 of the neck 11.

The assembly operation heretofore described is facilitated if the beads 57 and 60 are interrupted, since the cap skirt 54 may then stretch more readily to permit assembly. The lower edge 67 of the skirt 54 fits snugly against the top edges of the projections 41 and the tear tab 68 bends slightly outwardly as shown in FIG. 2 to a position where it may be conveniently gripped by the consumer. After the cap and neck have been thus assembled, the foil 71 is caused to adhere to the neck 11 by induction heating or other means which causes the adhesive 73 to adhere to surface 12.

The foregoing described cap has tamper-resistant features in that it is difficult to remove the cap from the neck without tearing the lower portion of the skirt below the tearline 81 and any effort to remove the cap without thus tearing the skirt is evident. Furthermore, the flanges 86, 88 and the like inhibit removal of the cap before the lower portion of the skirt has been torn off. As a further additional tamper evident feature, the foil seal 71 is tightly adhered to the neck 11 and cannot be removed without tearing the foil.

At the time of opening the container, the consumer pulls upward on the tear tab 68 and then around the tearline 81 causing the lower portion of the cap to be torn off. The flanges 86 or 87 may then be used to remove the upper portion of the cap providing access to the neck and the condition shown in FIG. 3. The edges of disc 71 escape from groove 72. The consumer then bends the foil tab 74 into a position where it may be conveniently gripped and pulls the tab 74, causing the disc 71 to tear away from the neck 11 and providing access to the interior of the container. The upper portion of the cap 51 above the tearline may be used for a reclosure cap.

Directing attention now to FIG. 5 a modified cap and neck are shown. It will be understood that for some usages (e.g., one-portion beverage bottles) the reclosure feature of the preceding modifications is not necessary. Accordingly, in the form of the invention shown in FIG. 5 the upper neck bead 22 and the upper internal cap bead 57 are eliminated. In other respects, the neck shown in FIG. 5 is substantially similar to those of the preceding modifications and the same reference numerals followed by the subscript b indicate corresponding parts.

What is claimed is:

1. A plastic cap for sealing a container neck of the type having a top finish and first interlocking means on the exterior of said neck below said top finish, said cap being of the type having a top disc and a depending skirt having internal second interlocking means adapted to engage said first interlocking means to hold said cap and neck finish assembled and having tear means to remove a lower portion of said skirt and at least a sufficient portion of said second interlocking means to permit removal of said cap from said neck and wherein there is a foil seal disc intially installed inside said cap and underlying said top disc so that, after said cap and neck are assembled, said foil seal disc may be caused to adhere to said top finish, the improvement comprising a groove formed in the interior of said skirt immediately below said top disc, the peripheral margin of said seal disc extending into said groove so that said seal disc is not dislodged from said cap prior to seating of said cap on said neck, said seal disc having adhesive on the underside of said seal disc of the type which, upon heating of said cap and neck, adheres to said top finish, a pull tab integral with said seal disc which may be gripped with the fingers to pull said seal disc off said neck, said pull tab being initially folded over said disc and being tucked underneath said top disc and above said seal disc, said second interlocking means being spaced substantially below said groove, said groove retaining said seal disc independent of either said first or second interlocking means.

2. In combination a container neck comprising a top finish, an external substantially straight first vertical wall, a groove below said wall forming a first shoulder at the lower edge of said first vertical wall, a downward-outward slanted wall below said groove, and a second vertical wall below said slanted wall; and a cap comprising a top disc, a skirt depending from said disc, said skirt having an internal bead having a second shoulder on its upper edge positioned to lock under said first shoulder with said internal bead extending into said groove, said skirt being formed with a horizontal scoreline above said internal bead, a pull tab and means associated with said pull-tab to tear off the portion of said skirt which includes said internal bead to permit removal of the portion of said cap above said horizontal scoreline, a foil seal disc having adhesive means on its lower surface of the type to detachably secure said seal disc to said finish, said seal disc initially fitting inside said cap and remaining sealed to said finish when said cap is removed from said neck, a pull tab integral with said seal disc which may be gripped with the fingers to pull said seal disc off said neck, said pull-tab being initially folded over said seal disc and being tucked underneath said top disc and above said seal disc, said second interlocking means being spaced substantially below said groove, said groove retaining said seal disc independent of either said first or second interlocking means.

* * * * *

UNITED STATES PATENT AND TRADEMARK OFFICE

CERTIFICATE OF CORRECTION

PATENT NO. : 4,739,891

DATED : April 26, 1988

INVENTOR(S) : Joseph J. Bullock, III

It is certified that error appears in the above—identified patent and that said Letters Patent is hereby corrected as shown below:

Initial page, item [73] to read:

-- [73] Assignee: Cap Snap Co., San Jose, CA. --

Signed and Sealed this

Fourth Day of October, 1988

*Attest:*

DONALD J. QUIGG

*Attesting Officer*

*Commissioner of Patents and Trademarks*